US005443048A

United States Patent [19]

Nicol et al.

[11] Patent Number: 5,443,048

[45] Date of Patent: Aug. 22, 1995

[54] FUEL PUMPING APPARATUS

[75] Inventors: Stuart W. Nicol, London; Peter A. G. Collingborn; Christopher Stringfellow, both of Kent; Ronald Phillips, Middlesex, all of England

[73] Assignee: Lucas Industries Public Limited Company, England

[21] Appl. No.: 277,877

[22] Filed: Jul. 20, 1994

[30] Foreign Application Priority Data

Jul. 23, 1993 [GB] United Kingdom ..... 9315342

[51] Int. Cl.[6] ..... F02M 41/00; F04B 19/00

[52] U.S. Cl. ..... 123/450; 123/198 D; 417/462; 417/486

[58] Field of Search ..... 123/450, 198 D, 495; 417/462, 463, 486, 487, 488

[56] References Cited

U.S. PATENT DOCUMENTS

| | | | |
|---|---|---|---|
| 3,498,226 | 3/1970 | Mowbray | 123/450 |
| 3,506,381 | 4/1970 | Kemp | 123/450 |
| 4,378,962 | 4/1983 | Law | 417/486 |
| 4,470,760 | 9/1984 | Jarret | 123/450 |
| 4,552,117 | 11/1985 | Djordjeuic | 123/450 |
| 4,667,641 | 5/1987 | Djordjeuic | 417/462 |
| 4,927,338 | 5/1990 | Ito | 417/462 |
| 4,936,755 | 6/1990 | Greeves | 417/462 |
| 5,044,898 | 9/1991 | Harris | 123/450 |
| 5,215,060 | 6/1993 | Klopfer | 123/450 |

FOREIGN PATENT DOCUMENTS

| | | | |
|---|---|---|---|
| 2086490 | 5/1982 | United Kingdom | 123/450 |
| 2199902 | 7/1988 | United Kingdom | 123/450 |

*Primary Examiner*—Carl S. Miller

*Attorney, Agent, or Firm*—Andrus, Sceales, Starke & Sawall

[57] ABSTRACT

A rotary distributor type fuel pumping apparatus has two pairs of plungers housed in respective diametrical bores which intersect each other. One of the plungers is longer than the remaining plungers conveniently by providing an extension at its inner end. The extension lies in the paths of movement of the remaining plungers so as to minimize the risk of damage to the plungers.

3 Claims, 3 Drawing Sheets

FUEL PUMPING APPARATUS

This invention relates to a rotary distributor type fuel pumping apparatus for supplying fuel to an internal combustion engine, the apparatus comprising a rotary distributor member mounted for rotation in a housing, at least three pumping plungers mounted in radial drillings respectively formed in the distributor member, the axes of the drillings lying in a common radial plane and the drillings at their inner ends intersecting to form a common pumping space, an annular cam ring surrounding the distributor member and having a plurality of cam lobes formed on its internal peripheral surface whereby during rotation of the distributor member inward movements will be imparted to the pumping plungers to displace fuel from the pumping space to an outlet, and means for supplying fuel to the pumping space to effect outward movement of the plungers.

In one example of the apparatus which has four pumping plungers it is usual to arrange the plungers in two pairs with the drillings associated with each pair of plungers forming part of a diametrically disposed bore. The two bores may be disposed at right angles to each other or at some other angle depending upon the type of engine to which fuel is to be supplied. Moreover, it is the practice to arrange that the plungers in one of the bores are longer than the plungers in the other bore so that at the limit of their inward movement the inner ends of the longer plungers almost touch and the inner ends of the shorter plungers almost touch the sides of the longer plungers. In this way the volume of fuel which remains in the pumping space at the end of the inward movement of the pumping plungers is kept to a minimum which is advantageous from the point of view of consistency of operation of the apparatus.

When the apparatus is at rest there is a tendency for the uppermost plunger to move downwardly under the action of gravity but even when the remaining plungers are at the outermost limits of their travel and it is one of the shorter plungers which moves downwardly, its movement has been halted by its engagement with a side surface or surfaces of one or the longer plungers. There has therefore been no problem when trying to start the associated engine. If however, the stroke of the plungers is increased in order to increase the volume of fuel which can be supplied by the apparatus, it has been shown to be possible in the situation outlined above for a shorter one of the plungers to move between the inner ends of the two longer plungers. As a result when the associated engine is cranked in order to achieve starting, the inner ends of the longer plungers can be urged into engagement with the shorter plunger resulting in serious damage to the apparatus.

It is known in distributor type pumps where a single bore and a pair of plungers is provided, to locate a spring intermediate the plungers. However, springs are notoriously unreliable in a high stress situation and there would be difficulty in accommodating the springs in two intersecting bores.

The object of the present invention is to provide an apparatus of the kind specified in an improved form.

According to the invention in an apparatus of the kind specified one of said plungers is longer than the remaining plungers whereby at its outermost position the inner end of said one plunger lies in the paths of movement of the remaining plungers.

An example of a fuel pumping apparatus in accordance with the invention will now be described with reference to the accompanying drawings in which.

Figure 1:
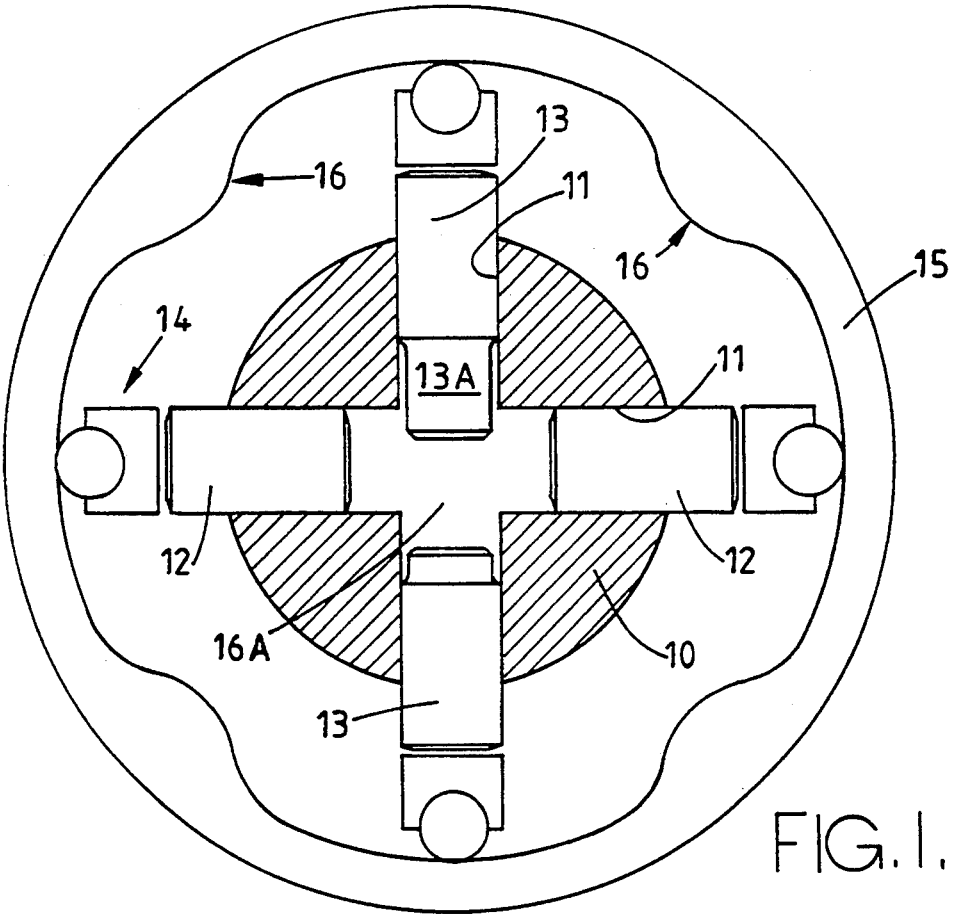
FIG. 1 is a cross-section through part of the apparatus.
Figure 4:
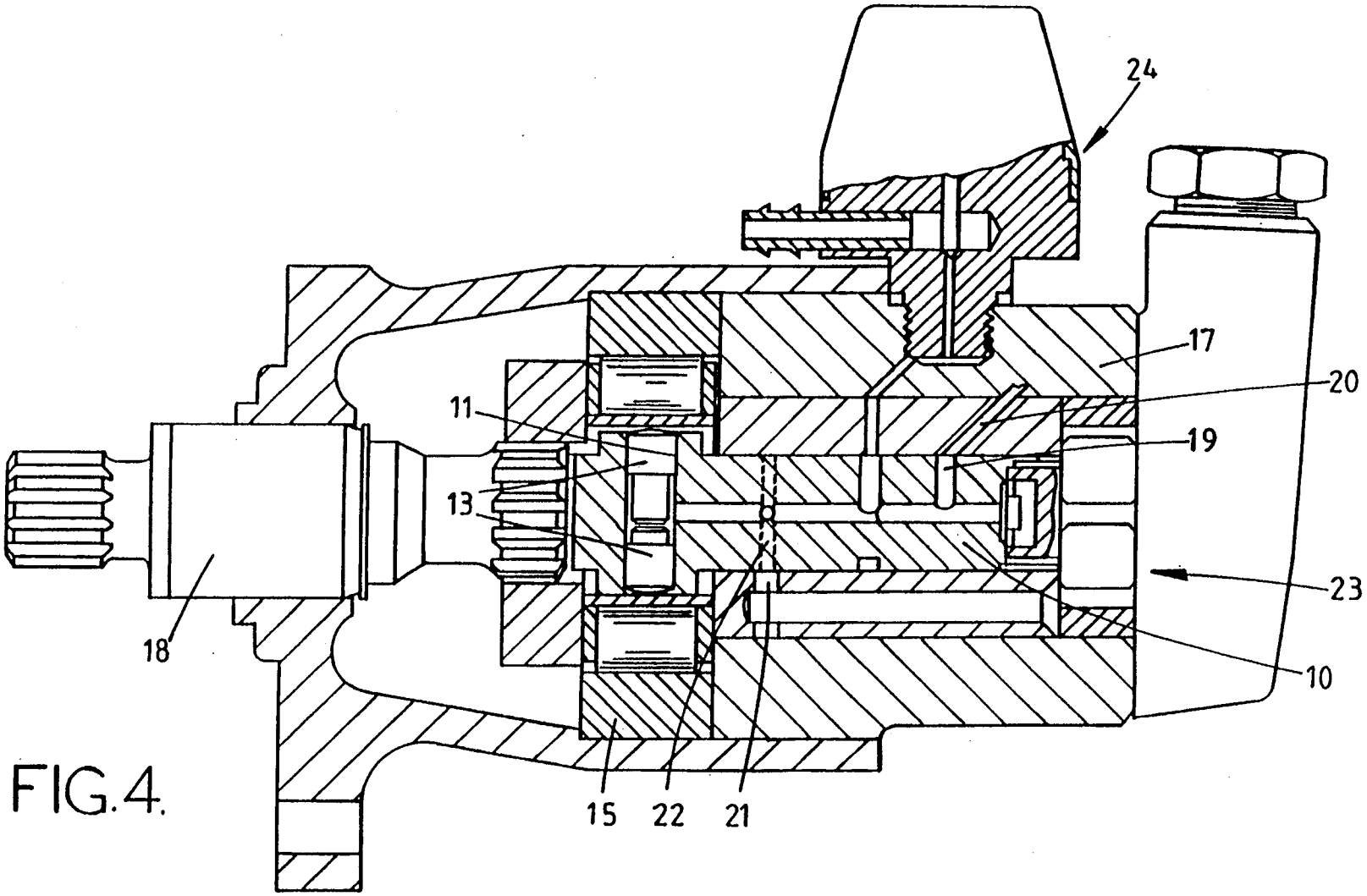
FIG. 4 shows a sectional side elevation of the apparatus.

Referring to FIGS. 1 and 4 of the drawings the apparatus is for supplying fuel to a four cylinder engine and comprises a rotary distributor member 10 which is mounted for rotation in a housing 17 and is driven by means of a drive shaft 18 which in use, is driven in synchronism with the associated engine.

Formed in the distributor member is a pair of diametrically disposed bores 11 the axes of which lie in a common plane so that the bores intersect. In the particular example the axes of the two bores are arranged at right angles.

Mounted in one of the bores 11 is a pair of pumping plungers 12 and in the other bore a pair of pumping plungers 13. At their outer ends the pumping plungers are engaged by cam followers 14 each of which comprises a shoe which carries a roller and the rollers can engage with the internal peripheral surface of an annular cam ring 15 which is supported in the housing 17 of the apparatus. The internal peripheral surface of the cam ring is provided with four cam lobes 16 which as the distributor member rotates, effect inward movement of the pumping plungers so as to discharge fuel from the pumping space 16A defined at the inner ends of the plungers. The pumping space in known manner communicates with a delivery passage 19 which is formed in the distributor member, and this can register in turn with four outlet ports 20 only one of which is shown, arranged in the housing so that fuel is delivered to the outlet ports in turn during successive inward movements of the pumping plungers. Fuel is supplied to the pumping space 16A to effect outward movement of the pumping plungers 12, 13 by way of an inlet port 21 in the housing and inlet passages 22 in the distributor member from a source of fuel such as a pump 23 of the vane type the rotary part of which is coupled to the distributor member 10 or may be coupled to the aforesaid drive shaft 18. The quantity of fuel which is supplied by the apparatus through the outlet ports is controlled by spilling fuel from the pumping space through a spill valve 24 or means may be provided to control the amount of fuel which is admitted to the pumping space.

Figure 2:
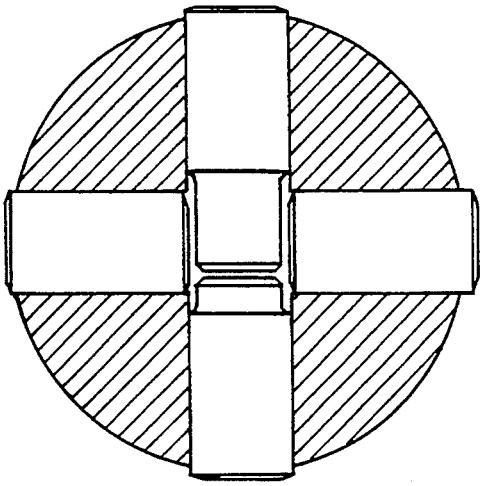
FIG. 2 shows a portion of the apparatus seen in FIG. 1 at a different setting.

In FIG. 1 the plungers 12, 13 are shown at the outermost limits of their travel, with the rollers lying on the base circle of the cam ring, whilst in FIG. 2 and also FIG. 4, they are shown at the innermost limits of their travel which is the position they adopt when the rollers are on the crests of the cam lobes.

It will be noted that one of the plungers 13 has an extension 13A to its inner end and the extension even at the outermost limit of travel of the plunger, lies in the path of movement of the plungers 12. The extension is of reduced diameter as compared with the main portion of the plunger. As shown, the other plunger 13 has a length which is slightly greater than the length of the plungers 12 and its inner end portion is also of reduced diameter, it is possible however for the said other plunger 13 to have the same length as the plungers 12.

If this is the case then the said other plunger 13 must have an identification mask to ensure that if the apparatus is serviced it will be replaced in the same bore as the one plunger 13. When the plungers are at the innermost limits of their travel as seen in FIG. 2, the inner end of the extension 13A almost touches the inner end of the other plunger 13 and the inner ends of the plungers 12 almost touch the side surfaces of the extension 13A and the plunger 13. The volume of fuel in the pumping space therefore at the end of the inward movement of the plungers is at a minimum.

When the apparatus is at rest there is a tendency for the uppermost plunger to fall downwardly under the action of gravity and even when it is one of the plungers 12 which is uppermost, the extension 13A will limit the downward movement of the plunger so that there is no possibility of one of the plungers 12 moving into the path of movement of the plungers 13. There is therefore no possibility of the inward movement of the plungers 13 being prevented as would be the case if the plungers 13 were of equal length as in the known forms of apparatus.

Figure 3:
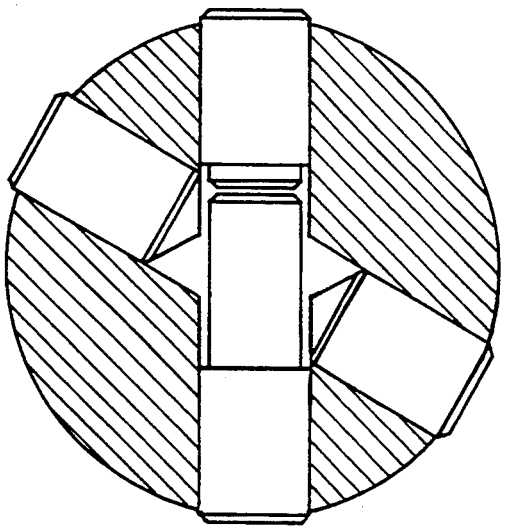
FIG. 3 shows a view similar to FIG. 1 of an alternative arrangement.

In the example the two bores are disposed at 90° C. relative to each other. For supplying fuel to some forms of engine the bores may be disposed at some other angle relative to each other but the modification as described is equally applicable to such pumps and FIG. 3 shows such an arrangement.

We claim:

1. A rotary distributor type fuel pumping apparatus for supplying fuel to an internal combustion engine, the apparatus comprising a rotary distributor member mounted for rotation in a housing, at least three pumping plungers mounted in radial drillings respectively formed in the distributor member, the axes of said drillings lying in a common radial plane and the drillings at their inner ends intersecting to form a common pumping space, an annular cam ring surrounding the distributor member and having a plurality of cam lobes formed on its internal peripheral surface whereby during rotation of the distributor member inward movements will be imparted to the pumping plungers to displace fuel from the pumping space to an outlet, means for supplying fuel to the pumping space and one of said plungers being longer than the remaining plungers so that at its outermost position the inner end of said one plunger lies in the paths of movement of the remaining plungers.

2. An apparatus according to claim 1, in which said one plunger has an extension at its inner end.

3. An apparatus according to claim 2, in which the other plungers are shorter in length than said one plunger.

* * * * *